US006260541B1

(12) United States Patent
Ricci-Ottati et al.

(10) Patent No.: US 6,260,541 B1
(45) Date of Patent: Jul. 17, 2001

(54) HYDRAULIC LASH ADJUSTER

(75) Inventors: Giulio Angel Ricci-Ottati, Burton; Russell Harmon Bosch, Gaines, both of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/558,515

(22) Filed: Apr. 26, 2000

(51) Int. Cl.[7] ..... F02M 37/04
(52) U.S. Cl. ..... 123/498
(58) Field of Search ..... 123/498, 90.48, 123/90.52, 90.55

(56) References Cited

U.S. PATENT DOCUMENTS 4,584,980 * 4/1986 Weiger et al. ..... 123/458
4,649,886 * 3/1987 Igashira et al. ..... 123/498
4,784,102 * 11/1988 Igashira et al. ..... 123/498
4,803,393 * 2/1989 Takahashi ..... 239/533.1
4,943,004 * 7/1990 Takahashi ..... 239/95
5,004,945 * 4/1991 Tomita et al. ..... 123/498

FOREIGN PATENT DOCUMENTS

WO99/18346 4/1999 (EP) .

* cited by examiner

*Primary Examiner*—Thomas N. Moulis
(74) *Attorney, Agent, or Firm*—John A. VanOphem

(57) ABSTRACT

A hydraulic lash adjuster is provided for interfacing between a piezoelectric element and a control valve in a piezoelectric actuated fuel injector. The hydraulic lash adjuster includes an inner plunger having an axial passage for storing a working fluid therein, and an outer body having a socket dimensioned to receive the inner plunger. The inner plunger is movably coupled into the socket of the outer body so as to form a working chamber between a bottom outer surface of the inner plunger and a bottom surface of the socket in the outer body. The hydraulic lash adjuster further includes a feed valve assembly disposed in the passage of the inner plunger for providing the working fluid from the passage to the working chamber, thereby minimizing the volume of the working chamber.

14 Claims, 2 Drawing Sheets

HYDRAULIC LASH ADJUSTER

TECHNICAL FIELD

The present invention relates generally to a hydraulic lash adjuster and, more particularly, to a hydraulic lash adjuster for use in a piezoelectric actuated fuel injector.

BACKGROUND OF THE INVENTION

Piezoelectric devices are attractive candidates as control valve actuators in common rail fuel injectors for diesel engines. The precise longitudinal deflection characteristic of piezoelectric devices in conjunction with their rapid dynamic response provides the potential of achieving meaningful control over the rate of fuel injection. Additionally, the relative high load capability of piezoelectric devices is consistent with the extremely high pressure environment of common rail fuel injectors.

Unfortunately, piezoelectric devices suffer from an extremely small deflection capability. Furthermore, piezoelectric devices are made from materials that exhibit a coefficient of thermal expansion that is much lower than the iron-based materials commonly used to house the piezoelectric devices within the fuel injectors. Accordingly, piezoelectric devices exhibit thermally induced lash that is significantly greater than their deflection capability. As a result, piezoelectric devices are rendered unusable as an actuator for fuel injectors without a means for thermal expansion compensation.

A hydraulic lash adjuster has been considered as a means for achieving thermal expansion compensation in a piezoelectric actuated fuel injector. A conventional hydraulic lash adjuster typically uses a relatively large volume liquid filled working chamber to compensate between the actuated and the actuating members. However, due to the extremely high pressures encountered in common rail fuel injectors, these conventional hydraulic lash adjusters will experience a loss in length caused by compression of the liquid. Since the piezoelectric actuator has a very short stroke, this length loss makes the conventional hydraulic lash adjuster unusable as a means for thermal expansion compensation in a piezoelectric actuated fuel injector.

Therefore, it is desirable to provide a hydraulic lash adjuster having a sufficiently small internal working volume to properly compensate for the length differences of the piezoelectric actuated fuel injector.

SUMMARY OF THE INVENTION

In accordance with the present invention, a hydraulic lash adjuster is provided for interfacing between a piezoelectric element and a control valve in a piezoelectric actuated fuel injector. The hydraulic lash adjuster includes an inner plunger having an axial passage for storing a working fluid therein, and an outer body having a socket dimensioned to receive the inner plunger. The inner plunger is movably coupled into the socket of the outer body so as to form a working chamber between a bottom outer surface of the inner plunger and a bottom surface of the socket in the outer body. The hydraulic lash adjuster further includes a feed valve assembly disposed in the passage of the inner plunger for providing the working fluid from the passage to the working chamber, thereby minimizing the volume of the working chamber.

For a more complete understanding of the invention, its objects and advantages, refer to the following specification and to the accompanying drawings.

DESCRIPTION OF THE PREFERRED EMBODIMENT

Figure 1:
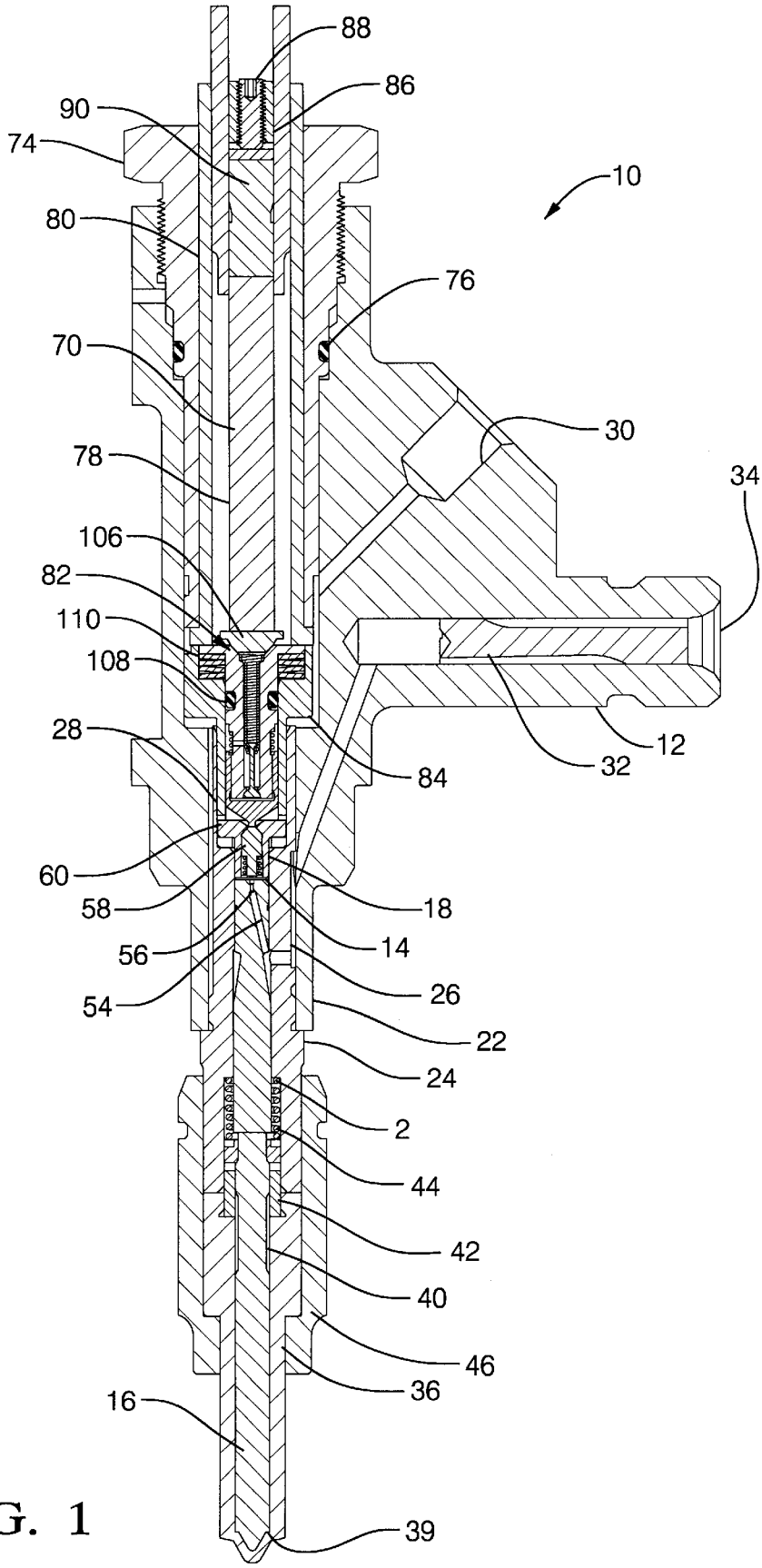
FIG. 1 is a cross-sectional view of an exemplary piezoelectric actuated fuel injector in accordance with the present invention.

An exemplary piezoelectric actuated fuel injector 10 is depicted in FIG. 1. The fuel injector 10 generally includes an injector body 12 having an axially extending fuel passage therein, a control chamber 14 disposed within the injector body 12, and an injector valve 16 axially movable within the fuel passage in accordance with the fuel pressure in the control chamber 14. While the following description is provided with reference to a particular fuel injector, it is readily understood that the broader aspects of the present invention are applicable to other types of and/or configurations for piezoelectric actuated fuel injectors.

In a presently preferred embodiment, the injector body 12 is comprised of a body housing 22 and a body insert 24 that are joined by means of a thermally assisted diametral interference fit. The body insert 24 includes localized flats on the joining diameter that form individual passages 26 and 28 after assembly with the body housing 22. The individual passages 26 and 28 conduct pressurized fuel into the injector and unpressurized fuel back through an outlet port 30 to the fuel return system (not shown), respectively. The injector body 10 further includes a fuel filter 32 that is press fit into a fuel inlet port 34.

The needle-type injector valve 16 is diametrally mated at one end to the injector body and at the other end to a spray tip 36. A hollow dowel 40 may be used to assure adequate alignment of the spray tip 36 and the injector body 12. The spray tip 36 centrally guides the injector valve 16, thereby assuring a positive liquid seal between the sealing angle at the end of the injector valve 16 and the valve seat 38 of the spray tip 36. In addition, the mated fit between the injector valve 16 and the spray tip 36 further defines a calibrated restrictive fuel passage 42, such that fuel flows through the passage 42 when the injector valve 16 is axially separated from the valve seat 40. In order to prevent leakage of fuel into the combustion chamber, a spring 44 may also be installed between the injector valve 16 and the injector body 12. In this way, the injector valve 16 maintains scaling contact with the valve seat 38 when the fuel system is not pressurized and/or when fuel delivery is not required. To prevent external fuel leakage, a threaded nut 46 is used to hold the spray tip 36 in intimate contact with the injector body 12.

A control valve assembly 18 is installed into the injection body 12 at the end of the injector valve 16 opposite the valve seat 38. A control chamber 14 is bounded by the control valve assembly 18. In order to actuate the injector valve 16, the control chamber 14 is filled with a working fluid (e.g., the fuel for the engine) and placed in fluid communication with the injector valve 16. In this preferred embodiment, the working fluid is provided by a passageway 54 that leads from the fuel inlet port 34 through a control orifice 56 and discharges into the control chamber 14.

The control valve assembly IS further includes an outwardly opening (i.e., against the direction of fuel flow) control valve 58 that is closely mated to a control valve seat 60. The control valve 58 is held in sealing position against the control valve seat 60 by the fuel pressure within the control chamber 14. When the fuel pressure is absent, the control valve 58 may be held in scaling position by a spring 62. A calibrated spacer 64 is used to control the gap between the end of the control valve seat and the injector 16, thereby establishing the stroke length for the injector valve 16. To prevent fuel leakage from the control chamber 14, the control valve assembly 18 is press fit into the mated diameter of the injector body 12. It is envisioned that other configurations for the control valve assembly are within the broader aspects of the present invention.

A piezoelectric actuator 70 is used to actuate the control valve 58. The piezoelectric actuator 70 is positioned in the upper portion of the injector body 12. The piezoelectric actuator 70 is then securely affixed into the injector body 12 by way of a threaded cap 74. A seal ring 76 may also be provided between the threaded cap 74 and the injector body 12 to prevent fuel leakage.

The piezoelectric actuator 70 is generally comprised of a piezoelectric element 78, piezo housing 80, a hydraulic lash adjuster 82, and a hydraulic lash adjuster housing 84. The piezo housing 80 is placed adjacent to the adjuster housing 84 which abuts against the control valve seat 60. The piezoelectric element 78 is equipped with suitably insulated terminals 86 for the applying voltage thereto, an adjusting screw 88 for manually minimizing assembly lash, and appropriate upper and lower plates 90 and 92 for force transmission. The position of the piezoelectric element 78 is adjusted by way of the screw 88 to minimize the gap between the push rod 82 and the control valve 58. As will be more fully explained below, the hydraulic lash adjuster 82 serves as an interface between the piezoelectric element 78 and the control valve 58.

In operation, high pressure fuel is delivered through the inlet port 34 from a pressurized plenum of the fuel delivery system (not shown). The fuel flow path proceeds through the fuel filter 32 to a point where the flow path is divided into two separate circuits. In the fuel delivery circuit, fuel flows through the annular passages surrounding the injector valve to the discharge opening in the valve scat 38. The passageways 26 and 28 arc sized to produce a specific known pressure loss when the injector valve 16 is opened.

In the control circuit, fuel flows though a drilled passage in the injector valve 16 through the control orifice 56 and into the control chamber 14. When the piezoelectric device 80 is not energized, the control valve 58 is held firmly in contact with the control valve seat 60 by the high pressure fuel, thereby preventing leakage to the fuel return port. When voltage is applied to the terminals, the piezoelectric element 78 expands longitudinally, thereby actuating the HLA 82 which in turn causes the control valve 58 to axially separate from the control valve scat 60. Thus, fuel escapes to the low pressure fuel return circuit. The resultant pressure drop in the control chamber 14 causes the injector valve 16 to axially separate from the valve seat 38 of the spray tip 36. When the piezoelectric element 78 is deenergized, it contracts to its original length, thereby allowing the control valve 58 to reseal against the control valve seat 60. Thus, the pressure level in the control chamber 14 returns to the pressure level delivered to the fuel inlet port 38. Since the pressure at the spray tip end of the injector valve 16 is less than the pressure in the control chamber 14, the injector valve 16 is quickly closed.

Figure 2:
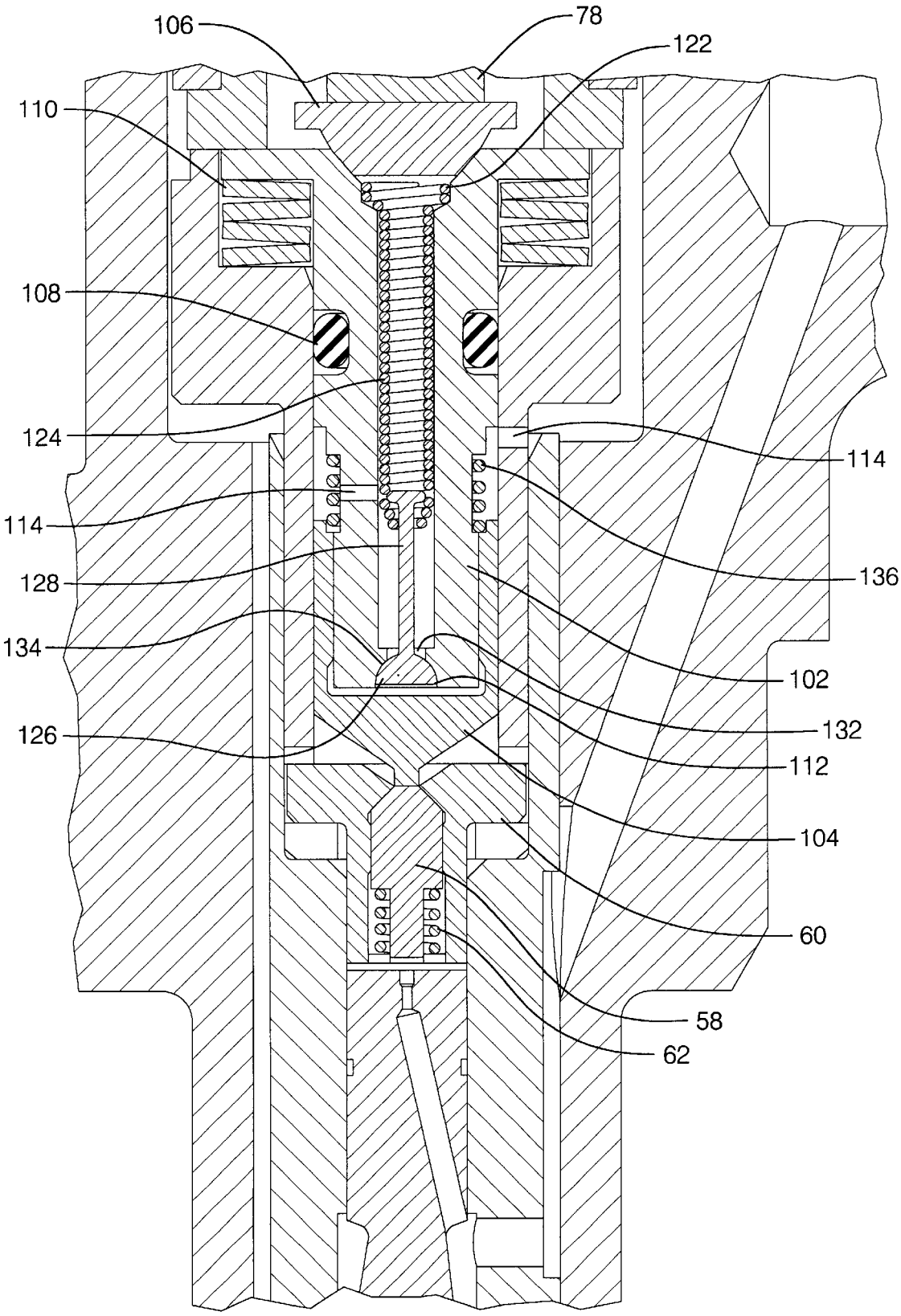
FIG. 2 is a fragmentary cross-sectional view of the exemplary fuel injector illustrating the hydraulic lash adjuster of the present invention.

Referring to FIG. 2, the hydraulic lash adjuster 82 (hereinafter referred to as "HLA") includes an inner plunger 102 and an outer body 104 enclosed within the HLA housing 84. A piston member 106 may be positioned between the piezoelectric element 78 and inner plunger 102 in order to compensate for alignment and tolerance variations between the piezoelectric element 78 and the HLA 82. In addition, a seal ring 108 may be positioned between the inner plunger 102 and the HLA housing 84 to prevent unwanted fuel from entering the housing 84, and a conical spring washer 110 may be positioned between the inner plunger 102 and the HLA housing 84 for preloading the piezoelectric element 78.

More specifically, inner plunger 102 provides an axial passage for a working fluid and the outer body 104 that defines a socket dimensioned to receive the inner plunger 102. The outer guide diameter of the inner plunger 102 is mated to the inner guide diameter of the outer body 104, so as to form a working chamber 112 between the bottom outer surface of the plunger 102 and the bottom surface of the socket in the outer body 104. It should be noted that the working chamber 112 must be large enough that the dimensional change differential between the piezoelectric actuator 70 and its surrounding housing does not allow contact between the bottom outer surface of the plunger 102 and the bottom surface of the socket in the Outer body 104. In addition, one or more suitable inlet ports 114 are provided to allow the working fluid (e.g., low-pressure return fuel) to enter into the axial passage of the inner plunger 102.

During the assembly process, the longitudinal position of the piezoelectric actuator 70 may be adjusted in order to minimize the volume of the working chamber. One skilled in the art will further recognize that the diametric clearance between the inner plunger 102 and the outer body 104 is extremely close so as to control the leakage of fuel from the working chamber 112 when the HLA 82 is transmitting force, and yet still allow relative axial motion between the plunger 102 and the outer body 104 when no external restraining force is applied.

A feed valve assembly 120 for providing the working fluid from the passage of the inner plunger 102 into the working chamber 112 is disposed in the passage of the inner plunger 102. The feed valve assembly 120 generally includes a feed valve 122 and feed valve spring 124. In particular, the feed valve 122 is further defined as a hemispherical valve element 126 attached to a rod 128. The lower end of the inner plunger 102 contains a diametric outlet 132 for transmitting the working fluid into the working chamber, where at least a portion of the outlet is a hemispherical depression 134 that forms a seat for the hemispherical valve element 126. The hemispheric shapes are used to assure intimate contact between the valve and the seat, as well as to minimize the volume of the working chamber 112. The feed valve 122 is axially movable in the passage of the inner plunger 102 between closed and open positions, such that the feed valve 122 sealingly engages in the hemispherical depression 134 in an closed position and axially separates from the depression 134 in an open position. The feed valve spring 124 is retained in the upper end of the inner plunger 102 in order bias the feed valve 122 towards the closed position.

Additionally, an extension spring 136 is disposed between a ledge along the outer surface of the inner plunger 102 and the top surface of the outer body 104 in a manner that axially separates the two components. In this way, the extension spring 136 assures intimate contact of the HLA 82 with the control valve 58 by increasing the length of the working chamber 112 and thereby eliminating any gaps that may exist or be thermally generated between the piezoelectric element 78 and the control valve 58. Since the design load of the extension spring 136 is less than that of the control valve spring 62, the extension spring 136 will not cause separation of the control valve 58 from the control valve scat 60. Moreover, the volume of the working chamber 122 is greatly reduced because neither the extension spring 136 or the rod 128 of the feed valve 122 is located within the working chamber 122.

In operation, the HLA 82 compensates for the thermal expansion between the piezoelectric element 78 and the surrounding injector components. Generally, the piezoelectric element 78 experiences longitudinal growth that is proportional to the applied voltage. The piezoelectric element 78 actuates the piston member 106 which in turn moves the inner plunger a distance equal to the longitudinal growth of the piezoelectric element 78. Initially, the feed valve is in a closed position. As the inner plunger 102 moves downwardly, there is an increase in the fluid pressure within the working chamber. Due to the minimized size of the working chamber, there is very little change in the fluid volume of the working chamber. Accordingly, the outer body 104 of the HLA and thus the control valve 58 are actuated substantially the same distance as the inner plunger 102.

As engine operation continues, the temperature of the engine and thus the fuel injectors increases. Due to the disparity between the coefficients of thermal expansion of the materials comprising the piezoelectric element 78 and the surrounding injector components, the temperature increase tends to cause a loss of contact between the piezoelectric element 78 and the inner plunger 102 of the HLA 82. Since the extension spring has a higher force load than the feed valve spring, it forces the outer body 104 to separate from the inner plunger 102 which in turn increases the size of the working chamber. As a result, the working chamber pressure is lowered, thereby allowing the feed valve to open and admit additional working fluid into the working chamber. In this way, the HLA 82 maintains intimate contact between the piezoelectric element 78 and the control valve 58. It should be noted that because the working chamber is located below the feed valve spring, any gas entrapped in the working fluid rises to the top of the axial passage in the plunger and thus does not enter into the working chamber.

After engine shutoff, as the injector temperature slowly returns to ambient conditions, the thermally induced length differences between the piezoelectric actuator and the surrounding injector components are reduced. As this occurs, the working fluid that has entered the working chamber is forced through the controlled clearance between outer guide diameter of the inner plunger 102 and the inner guide diameter of the outer body 104 by the urging of the control valve spring 62.

While the above description constitutes the preferred embodiment of the invention, it will be appreciated that the invention is susceptible to modification, variation, and change without departing from the proper scope or fair meaning of the accompanying claims.

What is claimed is:

1. A hydraulic lash adjuster for interfacing between a piezoelectric element and a control valve in a piezoelectric actuated fuel injector, comprising:

an inner plunger having an axial passage for storing a working fluid therein;

an outer body having a socket dimensioned to receive said inner plunger, said inner plunger movably coupled into the socket of said outer body so as to form a working chamber between a bottom outer surface of said inner plunger and a bottom surface of the socket in said outer body; and a feed valve assembly disposed in the passage of said plunger for providing the working fluid from the passage of said inner plunger to said working chamber, thereby minimizing the volume of said working chamber.

2. The hydraulic lash adjuster of claim 1 further comprises an extension spring disposed between a ledge along an outer surface of said inner plunger and a top surface of said outer body for axially separating said inner plunger from said outer body, thereby maintaining contact between the piezoelectric element and the control valve.

3. The hydraulic lash adjuster of claim 1 wherein said feed valve assembly is operable to transmit the working fluid from the passage of said inner plunger to the working chamber, thereby maintaining contact between the piezoelectric element and the control valve.

4. The hydraulic lash adjuster of claim 1 further comprising:

an outlet in said inner plunger for transmitting the working fluid into the working chamber; and a feed valve axially movable in the passage of said inner plunger between closed and open positions, wherein said feed valve sealingly engages the outlet in a closed position and axially separates from the outlet in an open position.

5. The hydraulic lash adjuster of claim 4 further comprising a feed valve spring disposed in the passage of said plunger for biasing said feed valve towards the closed position.

6. The hydraulic lash adjuster of claim 4 wherein the feed valve is further defined as a hemispherical valve element coupled to a rod, and the outlet of inner plunger is further defined as a hemispherical depression in the bottom outer surface of said inner plunger.

7. A piezoelectric actuated fuel injector for use in an internal combustion engine, comprising:

an injector body having an axially extending fuel passage therein;

a control chamber in fluid communication with a pressurized fuel source;

a control valve disposed within said control chamber for controlling fuel pressure in said control chamber;

an injector valve axially movable within the fuel passage between closed and open positions in accordance with a fuel pressure in the control chamber;

a piezoelectric actuator for actuating said control valve; and a hydraulic lash adjuster for interfacing between said piezoelectric actuator and said control valve, said hydraulic lash adjuster having a working fluid chamber for maintaining contact between the piezoelectric actuator and the control valve, and a feed valve assembly for providing a working fluid to the working chamber, wherein the feed valve assembly is disposed within said hydraulic lash adjuster, thereby minimizing the volume of the working chamber.

8. The fuel injector of claim 7 wherein said control valve selectively connects said control chamber to a low pressure fuel return circuit in order to reduce fuel pressure in said control chamber and thereby axially move the injector valve within the fuel passage.

9. The fuel injector of claim 7 wherein said hydraulic lash adjuster is further defined as an inner plunger having an axial passage for storing a working fluid therein, and an outer body having a socket dimensioned to receive said inner plunger, where said inner plunger is movably coupled into the socket of said outer body so as to form said working chamber between a bottom outer surface of said inner plunger and a bottom surface of the socket in said outer body.

10. The fuel injector of claim 9 further comprises an extension spring disposed between a ledge along an outer surface of said inner plunger and a top surface of said outer body for axially separating said inner plunger from said outer body, thereby maintaining contact between the piezoelectric element and the control valve.

11. The fuel injector of claim 9 wherein said feed valve assembly is operable to transmit the working fluid from the passage of said inner plunger to the working chamber, thereby maintaining contact between the piezoelectric element and the control valve.

12. The fuel injector of claim 9 further comprising:

an outlet in said inner plunger for transmitting the working fluid into the working chamber; and a feed valve axially movable in the passage of said inner plunger between closed and open positions, wherein said feed valve sealingly engages the outlet in a closed position and axially separates from the outlet in an open position.

13. The fuel injector of claim 12 further comprising a feed valve spring disposed in the passage of said plunger for biasing said feed valve towards the closed position.

14. The fuel injector of claim 12 wherein the feed valve is further defined as a hemispherical valve element coupled to a rod, and the outlet of inner plunger is further defined as a hemispherical depression in the bottom outer surface of said inner plunger.

* * * * *